United States Patent [19]

Hata

[11] 4,425,683

[45] Jan. 17, 1984

[54] SEPARABLE SLIDE FASTENER

[75] Inventor: Masahiko Hata, Tokyo, Japan

[73] Assignee: Yoshida Kogyo K. K., Tokyo, Japan

[21] Appl. No.: 311,429

[22] Filed: Oct. 14, 1981

[51] Int. Cl.[3] ..... A44B 19/24

[52] U.S. Cl. ..... 24/381; 24/434; 24/395; 24/413

[58] Field of Search ..... 24/205.11 R, 205.11 L, 24/205.11 F, 205.16 R, 205.16 C, 205.13 C; 66/193

[56] References Cited

U.S. PATENT DOCUMENTS

| | | | |
|---|---|---|---|
| 3,507,013 | 4/1970 | Inazawa | 24/205.16 C |
| 3,919,744 | 11/1975 | Kandov | 24/205.16 C |
| 3,962,756 | 6/1976 | Ebata | 24/205.16 C |
| 4,182,007 | 1/1980 | Yoshida et al. | 24/205.16 C |
| 4,319,387 | 3/1982 | Yoshida | 24/205.16 C |

FOREIGN PATENT DOCUMENTS

| | | | |
|---|---|---|---|
| 51-135709 | of 1976 | Japan | 24/205.16 R |
| 52-24161 | of 1977 | Japan . | |

*Primary Examiner*—Paul J. Hirsch

*Attorney, Agent, or Firm*—Hill, Van Santen, Steadman & Simpson

[57] ABSTRACT

A separable slide fastener comprises a pair of warp-knit stringer tapes each having a pair of webs with a wale-free region therebetween, which are interconnected by a connector thread extending across the wale-free region at longitudinal intervals, the wale-free region being receptive of a chain of thread loops for attaching the stringer tape to a fabric. A pair of rows of coupling elements is mounted on opposite longitudinal edges of the stringer tapes and taken into and out of interdigitating engagement by a slider movable along the rows of coupling elements. The stringer tapes have at one end thereof a separable bottom end stop. A reinforcement member is mounted on each of the stringer tapes at the one end thereof and connected to the separable bottom end stop. The reinforcement member extends between the tape webs across the wale-free region and includes a tapered body having a pair of inclined opposite surfaces disposed one on each side of the stringer tape and diverging progressively away from each other such that the body increases progressively in cross section outwardly away from the separable bottom end stop. When the slide fastener is attached to a knit fabric by a chain of thread loops, the tapered body engages a lowermost one of the thread loops and prevents the lowermost loop from being displaced off the reinforcement body.

4 Claims, 8 Drawing Figures

SEPARABLE SLIDE FASTENER

BACKGROUND OF THE INVENTION

1. Field of the Invention

The present invention relates to a separable slide fastener for use on knit garments such as cardigan sweaters.

2. Prior Art

There have been proposed separable slide fasteners which have in their stringer tapes longitudinal coarse regions or openings loosely receptive of a chain of thread loops for attaching the stringer tape to a knit garment, and which include a separable bottom end stop mounted on a lower end of the stringer tape. Such separable slide fasteners are described in copending U.S. patent applications Ser. Nos. 223,201 and 258,647 filed Jan. 7, 1981 and Apr. 29, 1981, respectively, which have been assigned to the present assignee. The proposed separable slide fasteners are connected to knit garments on a knitting machine or linking machine with needles of the machine insertable into the openings in the stringer tape. The separable slide fastener as attached to the knit garment is prevented from becoming puckered or wavy since the openings in the tape that loosely accommodate the thread loops take up forces applied to the knit garment. The knit garment such as a cardigan sweater, while worn with the slide fastener closed, is subjected to a lateral pull particularly at its hem or lower end around the wearer's waist, imposing more tension on a lower end of the slide fastener than on other parts of the latter. Therefore, an end of the chain of thread loops which extends around the lower end of the slide fastener is likely to be displaced laterally off the tape end under continued or sudden lateral stresses.

SUMMARY OF THE INVENTION

A separable slide fastener according to the present invention includes a reinforcement member mounted on each of the stringer tapes at a lower end thereof and connected to a separable bottom end stop attached to the end of the stringer tape, the reinforcement member extending transversely of the stringer tape across a wale-free coarse region between laterally spaced webs of the stringer tape. The reinforcement member includes a thick body injection-molded around the lower end of the stringer tape and having a pair of opposite surfaces disposed one on each side of the stringer tape and diverging progressively away from each other such that the body increases progressively in cross section outwardly away from the separable bottom end stop. When the separable slide fastener is attached to a knit fabric by chains of thread loops, the tapered body of the reinforcement member engages a lowermost one of the thread loops and prevents the lowermost loop from being displaced thereoff in a direction away from the separable bottom end stop. The thick body may have a bottom surface facing away from the stringer tape at an angle of inclination with respect to the end of the slide fastener. The thick body may also have a central opening for receiving therein lower thread loops by which the slide fastener is attached to a knit fabric.

It is an object of the present invention to provide a separable slide fastener attachable to a knit garment and having means for anchoring a thread loop stably on a separable bottom end stop on a lower end of the slide fastener against displacement under forces applied to the knit garment to which the slide fastener is attached.

Many other advantages and features of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
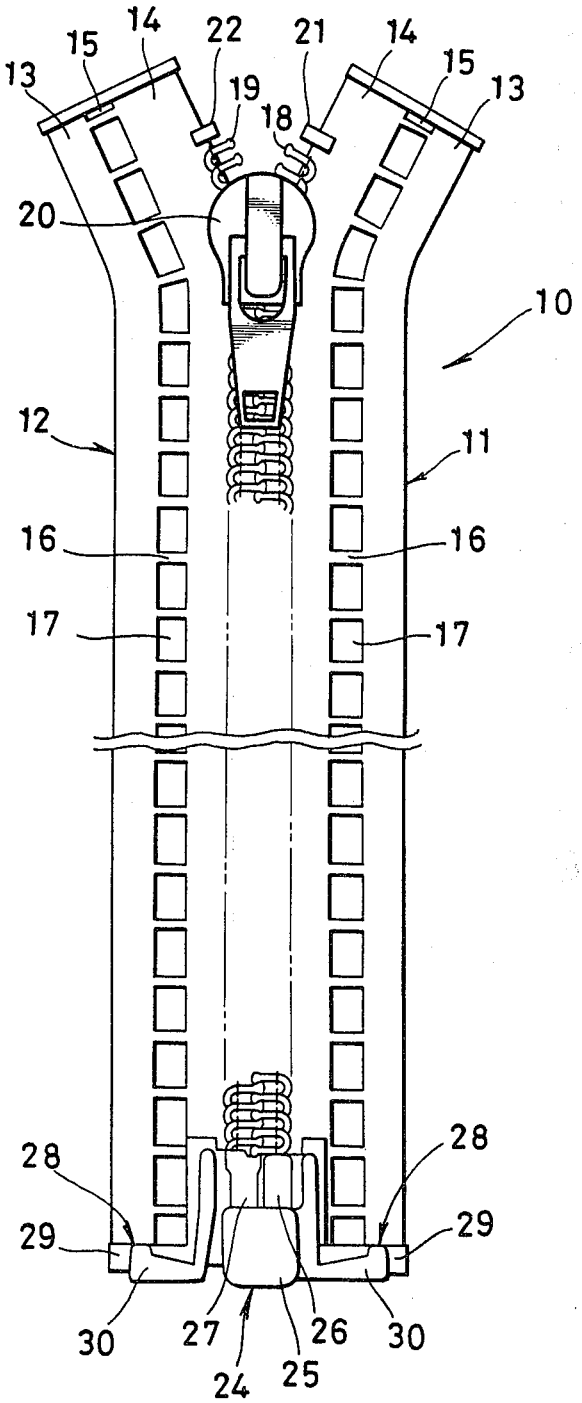
FIG. 1 is a plan view of a separable slide fastener according to the present invention.

As shown in FIG. 1, a separable slide fastener 10 for use on a garment such as a cardigan sweater having completely separable opposite edges along which the fastener is attachable, comprises a pair of warp-knit stringer tapes 11, 12 each including a pair of first and second longitudinal warp-knit webs 13, 14 with a wale-free coarse region 15 therebetween which is preferably devoid of one to four wales. The webs 13, 14 are interconnected by a connector thread 16 extending transversely across the wale-free region 15 at longitudinal intervals, providing a plurality of rectangular openings 17 arranged longitudinally in and along the wale-free region 15. A pair of rows of coupling elements 18, 19 which are made preferably of filamentary plastic material is mounted respectively on the second webs 14, 14 along longitudinal opposite edges thereof. A slider 20 is slidably mounted on the rows of coupling elements 18, 19 for taking the latter into and out of interdigitating engagement to open and close the slide fastener 10.

A pair of top end stops 21, 22 is secured respectively to the opposed edges of the webs 14, 14 and located at upper ends of the stringer tapes 11, 12 to prevent the slider 20 from moving off the rows of coupling elements 18, 19 past the top end stops 21, 22. A separable bottom end stop 24 is mounted on lower ends of the stringer tapes 11, 12 and includes a box 25 and a box pin 26 extending therefrom, the box 25 and the box pin 26 being injection-molded on the lower end of the stringer tape 11, and a pin 27 injection-molded on the end of the stringer tape 12 and insertable into and removable from the box 25 in parallel relation to the box pin 26. The separable bottom end stop 24 is located at a lower end of the rows of coupling elements 18, 19.

Figure 2:
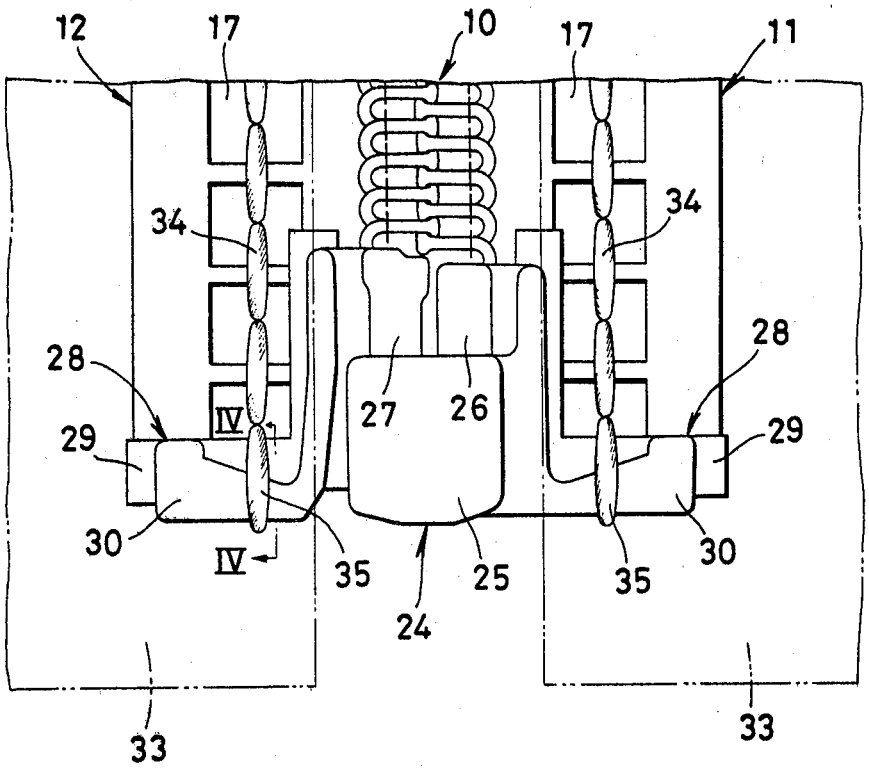
FIG. 2 is an enlarged fragmentary plan view of the separable slide fastener illustrated in FIG. 1.
Figure 3:
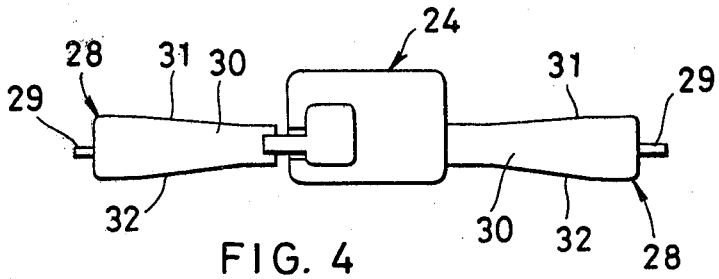
FIG. 3 is an end view of the separable slide fastener of FIG. 1.
Figure 4:
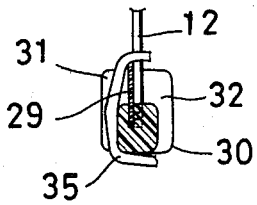
FIG. 4 is a cross-sectional view taken along line IV—IV of FIG. 2.

As best illustrated in FIGS. 2 and 3, a pair of reinforcement members 28, 28 of thermoplastic synthetic resin is mounted on the lower ends of the stringer tapes 11, 12, respectively and connected to the separable bottom end stop 24. Each of the reinforcement members 28 includes an L-shaped thin film 29 bonded to the stringer tape and a thick body 30 injection-molded on the tape and extending transversely between the first and second webs 13, 14 across the wale-free region 15, the body 30 being disposed around the lower end of the stringer tape as best shown in FIG. 4.

As shown in FIG. 3, the thick body 30 is of a tapered configuration having a pair of opposite surfaces 31, 32 disposed one on each side of the stringer tape 11, 12 and diverging progressively away from each other such that the body 30 increases progressively in cross section outwardly away from the separable bottom end stop. With the separable slide fastener 10 attached to a knit fabric 33 (FIG. 2) by chains of thread loops 34, the bodies 30 with the inclined surfaces 31, 32 engage lowermost end loops 35 and prevent the latter from being displaced off the bodies 30 in a direction away from the separable bottom end stop 24 even under forces tending to pull the stringer tapes 11, 12 laterally apart.

Figure 5:
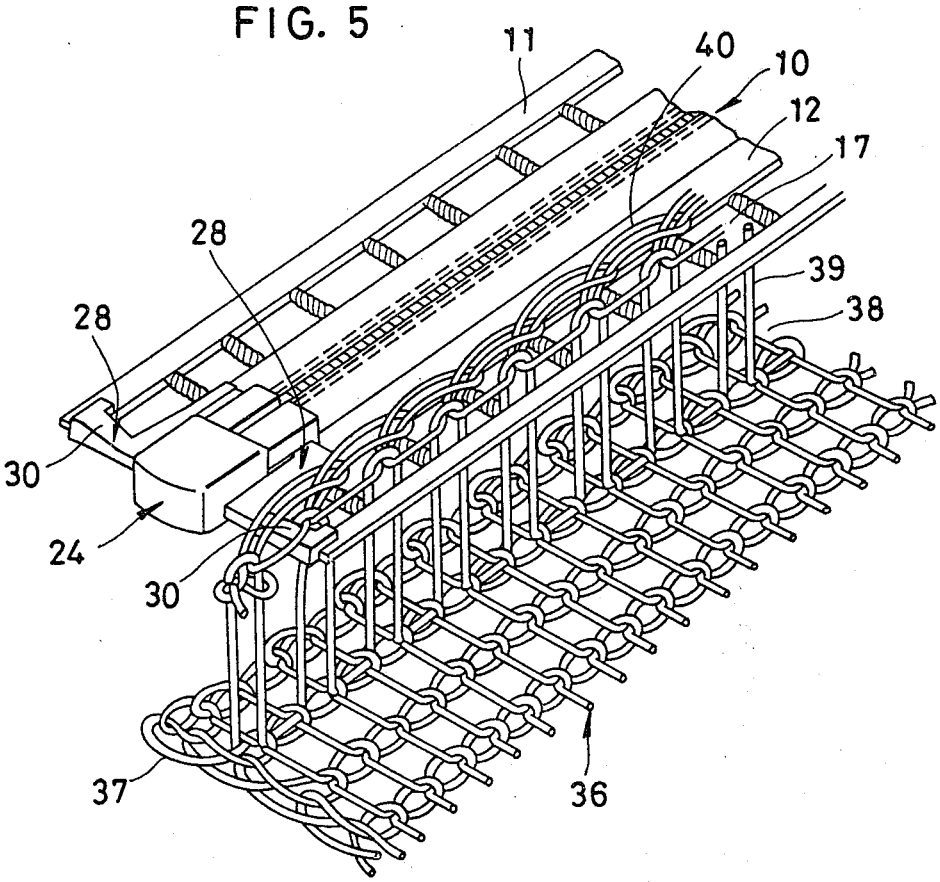
FIG. 5 is an enlarged fragmentary perspective view of the separable slide fastener shown in FIG. 1 as attached to a knit fabric with thread loops.

As illustrated in FIG. 5, the slide fastener 10 can be attached to a knit fabric 36 along an edge 37 thereof on a knitting or linking machine having knitting needles or points (not shown) inserted through the knit fabric 36 along a coarse 38 and the openings 17 in the stringer tapes. Upon operation of the machine, needle loops 39 are looped around the needles and then interlooped with a chain of thread loops 40, thus forming a double chain stitch which connects the slide fastener 10 to the knit fabric 36.

Figure 6:
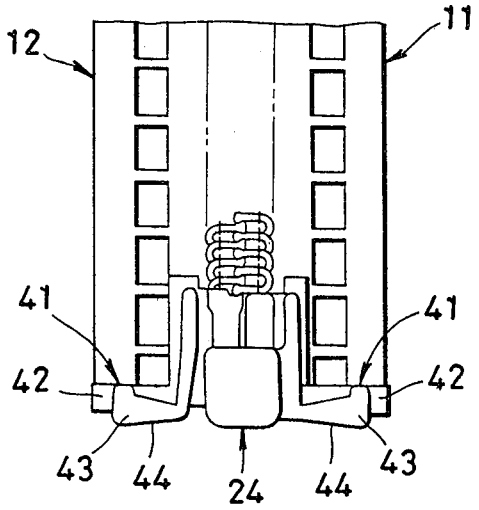
FIG. 6 is a fragmentary plan view of a separable slide fastener according to another embodiment.

According to another embodiment shown in FIG. 6, a reinforcement member 41 comprises an L-shaped thin film 42 and a thick body 43 having a bottom surface 44 facing away from the stringer tape 11, 12 at an angle of inclination with respect to the bottom end of the stringer tape 11, 12. With this arrangement, a thread loop (not shown) disposed around the body 43 is prevented by the inclined bottom surface 44 from being displaced off the body 43.

Figure 8:
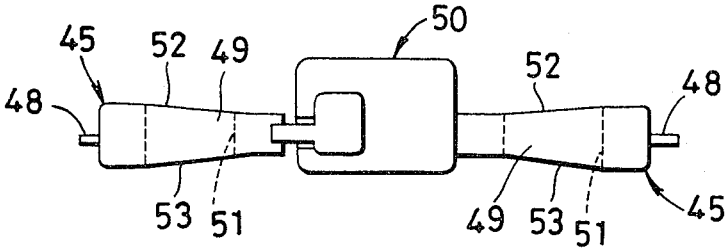
FIG. 8 appearing with FIG. 5 is an end view of the separable slide fastener illustrated in FIG. 7.
Figure 7:
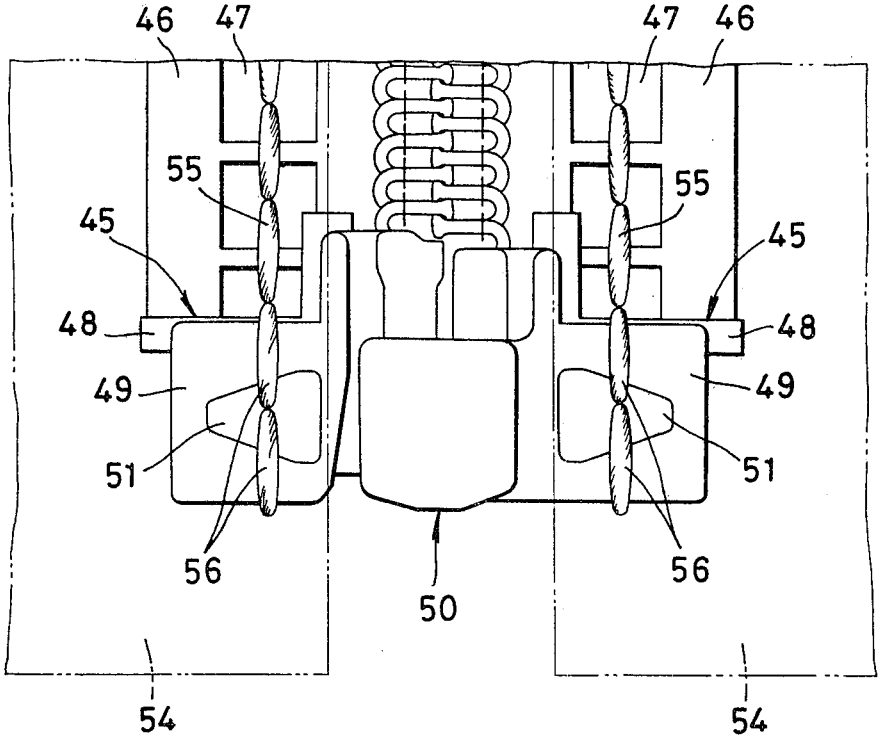
FIG. 7 is a fragmentary plan view of another separable slide fastener as mounted on a knit fabric.

FIGS. 7 and 8 illustrate still another embodiment in which a reinforcement member 45 on each stringer tape 46 having a wale-free region 47 comprises a thin film 48 and a thick body 49 connected to a separable end stop 50 and extending across the wale-free region 47. The thick body 49 has a central opening 51 of a substantially triangular shape which is substantially aligned with the wale-free region 47. The thick body 49 has a pair of opposite surfaces 52, 53 positioned one on each side of the stringer tape 46 and diverging away from each other such that the cross section of the body 49 increases progressively in a direction away from the separable bottom end stop 50. When attached to a knit fabric 54 by thread loops 55, lower thread loops 56 are received in the openings 51 and prevented by the inclined surfaces 52, 53 from being displaced off the bodies 49. The reinforcement bodies 49 also serve to stabilize the lower ends of the stringer tapes 46 when mounted on the knit fabric 54.

Although various minor modifications might be suggested by those in the art, it should be understood that I wish to embody within the scope of the patent warranted hereon, all such embodiments are reasonably and properly come within the scope of my contribution to the art.

I claim as my invention:

1. A separable slide fastener comprising:

(a) a pair of warp-knit stringer tapes each including a pair of first and second webs with a wale-free region extending longitudinally therebetween, and a connector thread interconnecting said first and second webs transversely across said wale-free region at longitudinal intervals, said stringer tapes being juxtaposed with said second webs disposed adjacent to each other, said wale-free region being receptive of a chain of thread loops for connecting said stringer tape to a fabric;

(b) a pair of rows of coupling elements each mounted on said second web of one of said stringer tapes remotely from said wale-free region;

(c) a slider movable along said pair of rows of coupling elements for engaging and disengaging the latter;

(d) a separable bottom end stop comprising a box and a box pin extending therefrom, which are mounted on one of said stringer tapes at one end thereof, and a pin mounted on the other stringer tape at one end thereof and insertable into said box; and (e) a reinforcement member mounted on each of said stringer tapes at said one end thereof and connected to said separable bottom end stop and extending between said first and second webs across said wale-free region, said reinforcement member including a body disposed around said one end of the stringer tape and extending transversely of said stringer tape, said body comprising a pair of opposite surfaces disposed one on each side of said stringer tape and diverging progressively away from each other such that said body increases progressively in cross section away from said separable bottom end stop, said body being engageable with an end of the chain of thread loops.

2. A separable slide fastener according to claim 1, said body including a surface facing away from said stringer tape with an angle of inclination with respect to said one end of said stringer tapes.

3. A separable slide fastener according to claim 1, said body having an opening receptive of a portion of the chain of thread loops.

4. A separable slide fastener comprising:

(a) a pair of warp-knit stringer tapes each including a pair of first and second webs with a wale-free region extending longitudinally therebetween, and a connector thread interconnecting said first and second webs transversely across said wale-free region at longitudinal intervals, said stringer tapes being juxtaposed with said second webs disposed adjacent to each other, said wale-free region being receptive of a chain of thread loops for connecting said stringer tape to a fabric;

(b) a pair of rows of coupling elements each mounted on said second web of one of said stringer tapes remotely from said wale-free region;

(c) a slider movable along said pair of rows of coupling elements for engaging and disengaging the latter;

(d) a separable bottom end stop comprising a box and a box pin extending therefrom, which are mounted on one of said stringer tapes at one end thereof, and a pin mounted on the other stringer tape at one end thereof and insertable into said box; and (e) a reinforcement member mounted on each of said stringer tapes at said one end thereof and connected to said separable bottom end stop and extending between said first and second webs across said wale-free region, said reinforcement member including a body disposed around said one end of the stringer tape and extending transversely of said stringer tape, said body comprising at least one angular surface by which said body increases progressively in cross section away from said separable bottom end stop, said at least one surface being engageable with an end of the chain of thread loops.

* * * * *